United States Patent [19]

Mullaney

[11] Patent Number: 4,460,023

[45] Date of Patent: Jul. 17, 1984

[54] METHOD OF MAKING DRYER FABRIC HAVING ZONES OF DIFFERENT PERMEABILITY

[75] Inventor: Peter Mullaney, Raleigh, N.C.

[73] Assignee: Huyck Corporation, Wake Forest, N.C.

[21] Appl. No.: 382,234

[22] Filed: May 26, 1982

Related U.S. Application Data

[63] Continuation-in-part of Ser. No. 197,551, Oct. 16, 1980, abandoned.

[51] Int. Cl.[3] ..... D03D 23/00; D21F 7/12

[52] U.S. Cl. ..... 139/383 A; 139/412; 139/416; 162/DIG. 1

[58] Field of Search ..... 139/383 A, 425 A, 400–415, 139/353 R, 416; 102/DIG. 1, 348, 358; 34/116, 123, 95; 28/163, 168, 170; 210/499, 507

[56] References Cited

U.S. PATENT DOCUMENTS

| | | | |
|---|---|---|---|
| 1,936,495 | 11/1933 | Bauer, Jr. et al. | 139/416 |
| 2,448,201 | 8/1948 | Whewell | 28/163 |
| 2,672,169 | 3/1954 | Walters | 139/408 X |
| 4,261,392 | 4/1981 | Westhead | 139/383 A |
| 4,274,448 | 6/1981 | Westhead | 139/383 A |
| 4,290,209 | 9/1981 | Buchanan et al. | 139/383 A |

FOREIGN PATENT DOCUMENTS

| | | | |
|---|---|---|---|
| 23717 | 8/1883 | Fed. Rep. of Germany | 210/499 |
| 1207446 | 9/1970 | United Kingdom | 139/383 A |
| 1220531 | 1/1971 | United Kingdom | 139/383 A |

*Primary Examiner*—James Kee Chi

*Attorney, Agent, or Firm*—Kenway & Jenney

[57] ABSTRACT

A method for making a woven dryer fabric having different permeabilities in different sections across its width to control the moisture profile of a web being conveyed through the dryer section of the papermaking machine is disclosed. Additional cross machine yarns are interwoven only over a selected distance or distances across the fabric in the cross machine direction. The non-interwoven segments of the additional cross machine direction yarns form surface floats which are subsequently removed by shearing.

14 Claims, 10 Drawing Figures

METHOD OF MAKING DRYER FABRIC HAVING ZONES OF DIFFERENT PERMEABILITY

CROSS-REFERENCE TO RELATED APPLICATION

The present application is a continuation-in-part of my copending U.S. application Ser. No. 197,551, filed Oct. 16, 1980, now abandoned, for DRYER FABRIC AND METHOD OF MAKING IT.

BACKGROUND OF THE INVENTION

The usual papermaking machine has three primary sections: a forming section, a press section and a drying section. In the forming section, wet pulp is deposited on the forming surface of a forming fabric which is of the nature of a fluid-permeable endless belt. Vacuum is applied to the underside of the forming fabric to withdraw moisture from the pulp, causing the pulp to form a sheet on the forming fabric. From the forming section, the sheet is transferred to the press section and is conveyed by a press fabric through a series of press rolls to further remove water from the web. From the press section, the web is then transferred to the dryer section where it is passed about a series of heated dryer cylinders. One or more dryer fabrics are employed to press the moist web uniformly and successively against the dryer cylinders to dry the web. As used herein and in the claims, the term "papermaking machine" is to be considered in a broad or generic sense, the machine producing a paper or paper-like material such as pulp, board, asbestos sheet or other similar structures.

In the dryer section, the dryer cylinders are internally heated by steam or the like. The cylinders usually have imperforate surfaces for contacting the paper web. Other rolls, such as pocket rolls may have surfaces which are perforated or slotted to permit the passage of heated air therethrough to increase the drying action on the web.

Several problems are encountered in the dryer section. First of all, it has been found that the surface temperature of the dryer cylinders may vary axially across the cross machine direction by as much as 40° F. This produces the distinct possibility that some portions of the web will be subjected to greater drying action than other portions of the web, resulting in a non-uniform moisture profile across the web.

A second problem results from the fact that moisture from the paper web tends to collect in enclosed areas or "pockets" in the dryer section. Usually more moisture accumulates in the central portions of the pockets than in those portions of the pockets lying nearer the lateral edges of the dryer section, the portions nearer the lateral edges of the drying section being more readily ventilated by the surrounding atmosphere.

Thus, by virtue of the variance in temperature across the cross machine direction of the dryer cylinders and moisture accumulated in pockets in the dryer section, and web generally will have a higher moisture content near its center, than at its edges. This is undesirable from the standpoint of quality control of the end product. Prior art workers have taken numerous steps to alleviate this problem. First of all, dryer fabrics have been devised which are fluid-permeable, such dryer fabrics having an open weave. An exemplary open weave dryer fabric is taught in U.S. Pat. No. 2,180,054. Dryer fabrics in the form of nonwoven structures such as needled felts and perforated plastic belts have also been used. To further alleviate the problem, various types of air jet apparatus or exhaust means have been provided to eliminate moisture build-up in the dryer pockets. Such devices are generally extremely complex and difficult to maintain, particularly in new dryer sections capable of handling webs having a width of the order of 400 inches.

Yet another approach to the provision of a more uniform moisture profile across the web is taught in U.S. Pat. No. 3,867,766. According to the teachings of this reference, a fluid permeable dryer fabric is provided, the permeability of which varies at selected locations across its width. This is accomplished in several ways. In a first embodiment, the machine direction yarns in the edge regions of the dryer fabric are more closely spaced with respect to one another than in the center region of the dryer fabric. It is to be noted that the phrase "machine direction" used herein and in the claims refers to the direction of travel of the dryer fabric when mounted in the dryer section of the papermaking machine. The phrase "cross machine direction" refers to that direction transverse the dryer fabric and perpendicular to the direction of travel of the dryer fabric in the dryer section of the papermaking machine.

In another embodiment, U.S. Pat. No. 3,867,766 teaches selectively varying the diameter of the machine direction yarns so that those yarns which lie in the area desired to be of reduced permeability have a diameter greater than those machine-direction yarns located in the more permeable sections of the dryer fabric. In a third embodiment, this reference teaches the utilization of machine direction yarns having a higher bulk construction near the lateral edges of the dryer fabric. These yarns will tend to flatten and close off the effective open area between adjacent yarns, thus reducing the permeability of the dryer fabric near its edges. In a final embodiment, the dryer fabric is selectively treated with greater amounts of resin or the like at its edges, than in its center, to reduce permeability at the edges thereof.

The various approaches taught in the above mentioned U.S. Pat. No. 3,867,766, while effective, have certain drawbacks. For example, when the frequency of machine direction yarns is increased at the edges of the dryer fabric, the edges tend to resist stretch to a greater extent and operate at a higher tension than the center of the dryer fabric. Furthermore, as the machine direction yarns elongate and loose crimp, the cross machine direction yarns must accept crimp. However, the cross machine direction yarns and more difficult to bend as their ability to accept crimp is a function of the distance between the machine direction yarns. As a result, it has been found that dryer fabrics of the type taught in U.S. Pat. No. 3,867,766 demonstrate differences in machine direction physical characteristics across the width of the dryer fabric. These differences in machine direction physical characteristics between sections of differing end counts present problems in achieving uniform flatness across the width of the dryer fabric and, similarly, can give rise to difficulties in running flat and wrinkle free in the dryer section of the papermaking machine. Furthermore, it is generally accepted that higher operating tension in a dryer fabric gives rise to increased drying of the web. Therefore, dryer fabrics in which the edge portions have a higher frequency of machine directions yarns, to reduce the permeability and thereby the drying rate of the edge portions of the fabric, suffer some counteracting effects of increased drying of the web at the fabric edges due to their edges operating at a higher tension.

The use of one or more resin coatings on the dryer fabric to vary its permeability across its width has not proven very effective due to the difficulty of maintaining the resin coating throughout the life of the fabric. This is even more difficult to achieve in dryer fabrics made of monofilament yarns, due to the resistance of monofilament yarns to the acceptance of resin coatings.

The present invention is based upon the discovery that if, in a woven dryer fabric, additional cross machine direction yarns, which may be of various thicknesses or bulk, are located in the fabric at selected positions across the fabric, the permeability of the dryer fabric can be varied, by design, in different sections across its width. The additional cross machine direction yarns have little or no effect on the machine direction load bearing properties of the dryer fabric. Thus, there will be no substantial differences in machine direction physical characteristics between the sections of the dryer fabric having different permeabilities. Furthermore, the present invention can be practiced in the manufacture of dryer fabrics made substantially from monofilament yarns. The dryer fabrics of the present invention can also be pinseamed.

A well known problem encountered in the dryer section of a papermaking machine is frequently referred to as "edge flutter" in the web. This problem is more severe at the web edges and tends to limit the speed at which the dryer section of the papermaking machine can be run. The dryer fabrics of the present invention provide much better control of edge flutter in the web and therefore permit the dryer section to be run at higher speeds.

Another well known problem in the art is a malformation in the web edges known as "grainy edges" or "cockled edges" due to greater drying of the web at the edges and flutter. The dryer fabrics of the present invention tend to reduce or eliminate such malformations in the web edges.

Woven dryer fabrics are used in the dryer section of the papermaking machine in the form of endless belts. To this end, the dryer fabrics may be woven directly in the form of endless belts by endless weaving techniques well known in the art. In such an instance, the weft or filling yarns extend in the machine direction and the warp yarns extend in cross machine direction. Alternatively, the dryer fabrics can be flat woven with their ends joined by well known means to form continuous belts. When the dryer fabrics are flat woven, the warp yarns extend in the machine direction and the weft or filling yarns extend in the cross machine direction. While the dryer fabrics of the present invention can be woven by either technique, for purposes of an exemplary showing the dryer fabrics will be described herein in terms of flat woven fabrics.

DISCLOSURE OF THE INVENTION

The present invention provides a method of making a woven dryer fabric, for use in a papermaking machine or the like, having different permeabilities in different sections across its width to control the moisture profile of a web being conveyed through the dryer section of a papermaking machine. To achieve the different permeabilities in different sections of the dryer fabric, additional cross machine direction yarns, which may be of different thicknesses or bulk, are located in the dryer fabric at selected positions thereacross in the cross machine direction. In a first embodiment, the dryer fabric is woven utilizing any appropriate multi-layer weave and stuffer picks are woven with long floats across the center of the dryer fabric. The stuffer picks are interwoven with the warp in each edge section, and their interwoven lengths extend inwardly in the cross machine direction for a predetermined distance toward the center of the fabric. The central surface floats (lengths not interwoven) of the stuffer picks, due to their length, may be easily lifted by hand and removed by shearing. This provides a dryer fabric having a central section of high permeability and edge sections of lesser permeability.

In a second embodiment, stuffer picks are introduced in the edge sections of the dryer fabric, as in the first embodiment. Additional stuffer picks of lesser diameter or less bulk are interwoven with the warp in the center section of the dryer fabric, extending in the cross machine direction between opposed edge section stuffer picks, and float across the edge sections also to be subsequently sheared off. The resulting dryer fabric of this second embodiment differs from the first embodiment in that the center section of the dryer fabric has a somewhat reduced permeability, although the center section is still of greater permeability than the edge sections of the dryer fabric.

In a third embodiment, stuffer picks are again introduced at the edge portions of the dryer fabric. In this instance, however, alternate opposed pairs of stuffer picks at the edge sections are longer than the remaining edge stuffer picks. Again, additional stuffer picks of lesser diameter or less bulk are introduced into the dryer fabric extending between opposed edge stuffer picks. This provides a dryer fabric having edge sections containing the larger diameter stuffer picks, a center section containing the stuffer picks of less diameter or bulk and two intermediate sections containing alternate large diameter stuffer picks and stuffer picks of lesser diameter or bulk. As a consequence, the dryer fabric has five sections across its width of differing permeabilities. The centermost section has the greatest permeability. To either side of the center section are sections of intermediate permeability and at the edges are sections of the least permeability.

A fourth embodiment of the present invention is identical to the third embodiment with the exception that the stuffer picks of lesser diameter or bulk are omitted. This again yields a five section dryer fabric with the centermost section having maximum permeability.

In all of the embodiments of the present invention the width of the sections of the dryer fabric of differing permeabilities does not constitute a limitation. The various sections can be made of any appropriate width depending upon the ultimate conditions of use of the dryer fabric, the material being dried, the axial temperature variance of the dryer rolls, and the like. Similarly, the nature of the yarns from which the dryer fabric is woven does not constitute a limitation. Spun yarns, monofilament yarns, multifilament yarns and combinations thereof can be used.

BEST MODE OF CARRYING OUT THE INVENTION

Figure 1:
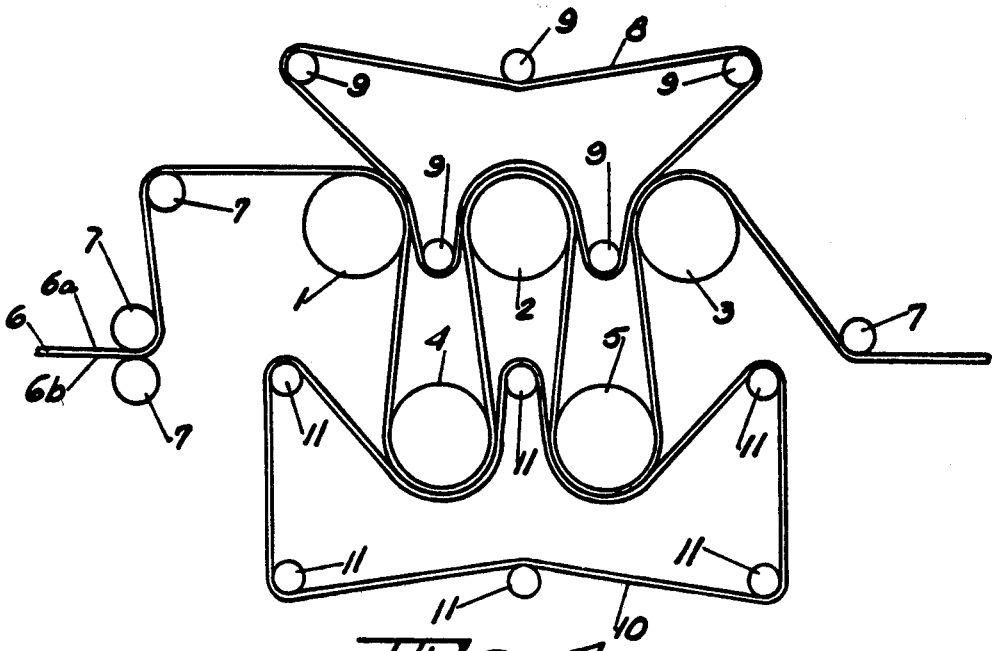
FIG. 1 is a semi-diagrammatic representation of an exemplary dryer section of a papermaking machine.

Reference is first made to FIG. 1 wherein an exemplary dryer section of a papermaking machine is shown. The dryer section is made up of an upper array of drying cylinders 1, 2 and 3 a lower array of drying cylinders 4 and 5. The drying cylinders 1 through 5 are heated by an appropriate means such as steam or the like. As indicated above, other rolls, such as rolls 9 and 11, may have imperforate surfaces, or perforated surfaces to permit the passage therethrough and through the web to be dried of heated air.

In FIG. 1, a web to be dried is shown at 6. The web has an upper surface 6*a* and a lower surface 6*b*. The web is guided to and from the dryer section by guide rolls 7. As indicated above, the web 6 may be of any material normally made in a papermaking or papermaking-like machine including paper, pulp, board, asbestos sheet or the like. It will be noted from FIG. 1 that the web travels through the dryer section in a senuous path, contacting each of the upper and lower dryer cylinders in order. It will further be noted that the upper surface 6*a* of web 6 is contacted by the cylinders 4 and 5 of the lower array, and the lower surface 6*b* of the web is contacted by cylinders 1, 2 and 3 of the upper array.

The dryer section of FIG. 1 is of the type utilizing two dryer fabrics. A first dryer fabric 8 is shown passing about portions of the upper array of cylinders 1, 2 and 3. The dryer fabric is appropriately guided and tensioned by additional pocket rolls 9. The purpose of the upper dryer fabric 8 is to bear upon web 6 as it passes about cylinders 1, 2 and 3, bringing the underside 6*b* of the web into intimate contact with the cylinders 1, 2 and 3.

A lower dryer fabric 10 passes about portions of the cylinders 4 and 5 of the lower array and is appropriately tension and guided by pockets rolls 11. Again, the purpose of lower dryer fabric 10 is to press the web 6 against dryer cylinders 4 and 5, bringing the upper surface 6*a* of the web into intimate contact with dryer cylinders 4 and 5. It will be understood that the dryer fabrics 8 and 10 are substantially identical, except for length, and the teachings of the present invention are applicable to either the upper or the lower dryer fabrics.

Figure 3:
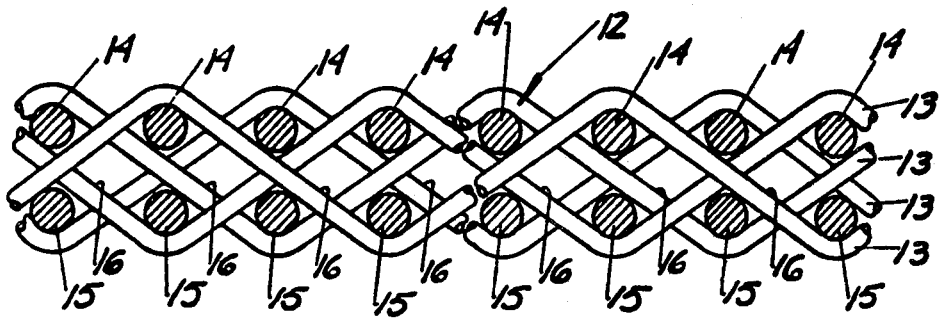
FIG. 3 is a fragmentary, semi-diagrammatic cross sectional view taken along section line 3—3 of FIG. 2.
Figure 4:
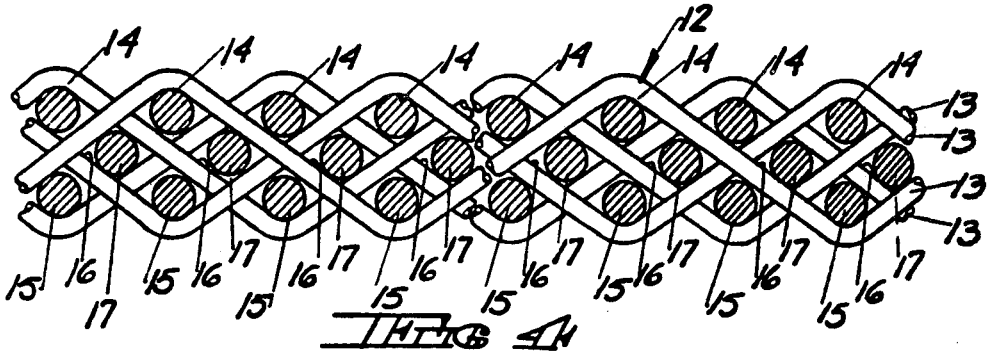
FIG. 4 is a fragmentary, semi-diagrammatic cross sectional view taken along section line 4—4 of FIG. 2.
Figure 2:
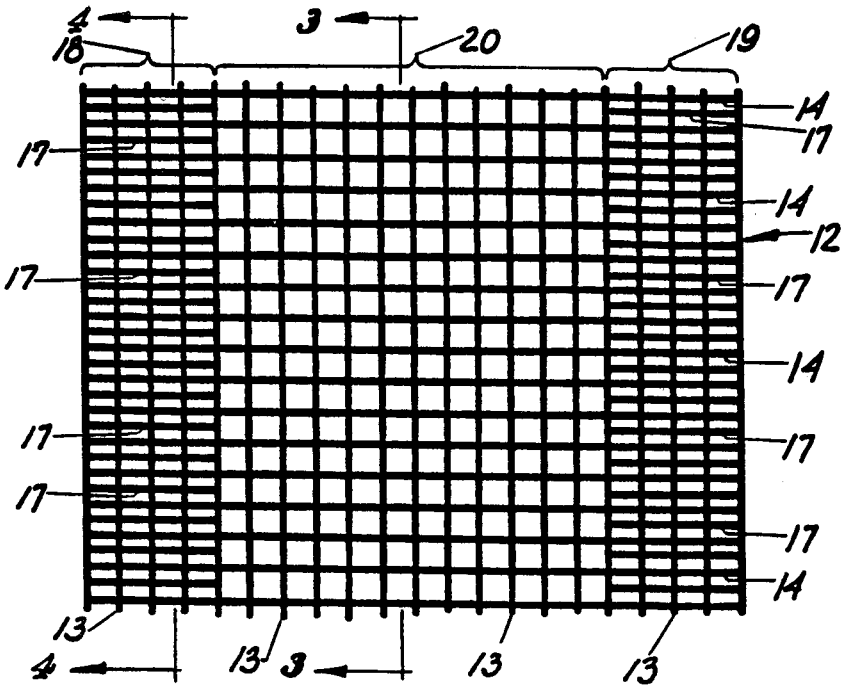
FIG. 2 is a fragmentary, semi-diagrammatic plan view of a first embodiment of dryer fabric of the present invention.

A first embodiment of the present invention is illustrated in FIGS. 2, 3 and 4, wherein like parts have been given like index numerals. Reference is first made to FIGS. 2 and 3. The dryer fabrics of the present invention are woven of yarns and the yarns may be spun yarns, monofilament yarns, multifilament yarns or combinations thereof. As indicated above, for purposes of an exemplary showing only, the dryer fabrics of the present invention will be described as flat woven.

It is a requirement of the present invention that the dryer fabrics be woven, utilizing a multi-layer weave. To this end, the embodiment of FIGS. 2, 3 and 4, generally indicated at 12, is shown in diagrammatic fashion as being made of a simple duplex weave. The warp or machine direction yarns are shown at 13. The weft or filling yarns (cross machine direction yarns) are arranged in two layers. The upper filling yarns are indicated at 14 and the lower filling yarns are shown at 15. Since the yarns 14 and 15 are arranged in vertical pairs, only yarns 14 are visible in FIG. 2. Both layers of filling yarns are shown in FIGS. 3 and 4.

It will be evident from the semi-diagrammatic representation of the simple duplex weave in FIG. 3 that a series of a diamond-shaped openings occur between the vertical pairs of filling yarns 14 and 15. These diamond-shaped openings are shown at 16.

In the embodiments of FIGS. 2 through 4, stuffer picks are inserted in the diamond-shaped openings 16 in the edge sections of the fabric. The stuffer picks are illustrated at 17 in FIG. 4. As is most clearly shown in FIG. 2, the stuffer picks 17 extend from the longitudinal edges of the dryer fabric 12 for a predetermined distance toward the center of the dryer fabric. It will be immediately evident from FIG. 2 that the dryer fabric 12 has three sections or zones. Edge sections 18 and 19 contain the stuffer picks 17. A central section or zone 20 is devoid of stuffer picks, the floats having been removed by shearing. As a result of the presence of stuffer picks 17 in sections 18 and 19, these sections will have a fluid permeability less than central section 20.

It will be understood by one skilled in the art that the width of sections 18, 19 and 20 does not constitute a limitation on the present invention. During the weaving process, sections 18, 19 and 20 may be tailored to have any desired width so that the dryer fabric 12 may have a cross machine direction permeability profile tailored to its particular end use. The width of sections 18, 19 and 20 will depend upon a number of factors such as the nature of the material from which the web 6 is made, the desired moisture profile for the dried web, the temperature variance along the axial length of dryer cylinders 1 through 5 in the cross machine direction, the yarns from which the dryer fabric is made, the width of the dryer fabric and the web 6, etc.

Figure 5:
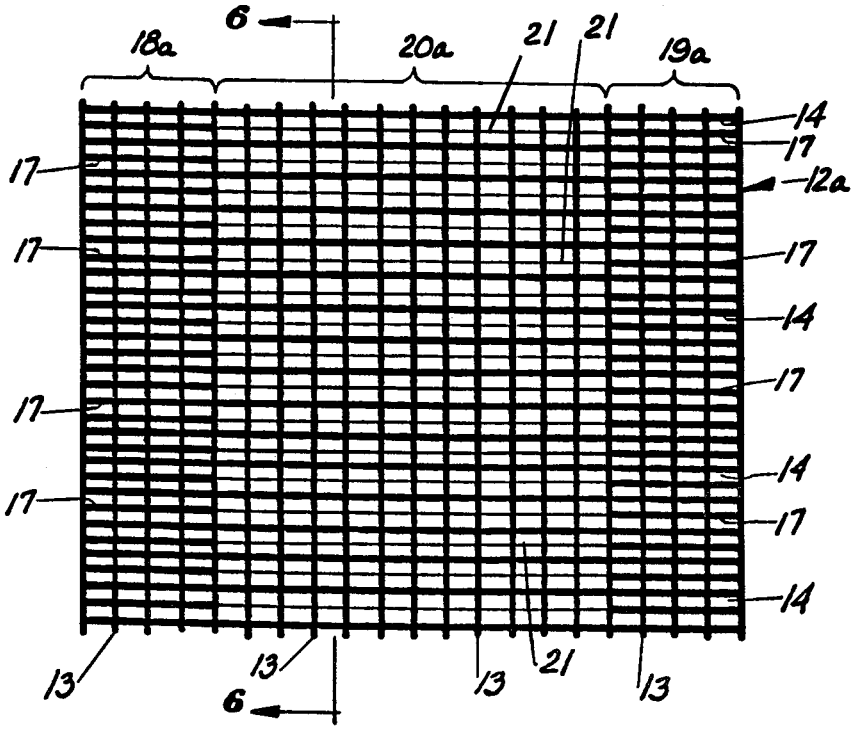
FIG. 5 is a fragmentary, semi-diagrammatic plan view of a second embodiment of dryer fabric of the present invention.
Figure 6:
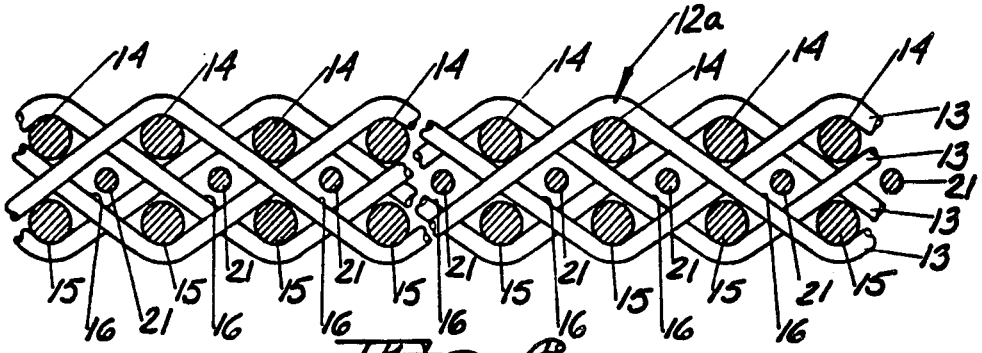
FIG. 6 is a fragmentary, semi-diagrammatic cross sectional view taken along section line 6—6 of FIG. 5.

FIGS. 5 and 6 illustrate a second embodiment of the present invention. In this embodiment, the dryer fabric is generally indicated at 12*a*. Dryer fabric 12*a* is substantially identical to dryer fabric 12 of FIGS. 2 through 4 and like parts have been given like index numerals. The dryer fabric 12*a* has warp or machine direction yarns 13, weft or filling yarns 14 and 15 in the cross machine direction and stuffer picks 17 extending inwardly from both longitudinal sides of the dryer fabric only through zones 18*a* and 19*a*. As a result, the dryer fabric 12*a* is again divided into two edge zones 18*a* and 19*a* and a central zone 20*a*. The only difference between the dryer fabric 12*a* of FIGS. 5 and 6 and the dryer fabric 12 of FIGS. 2 through 4 lies in the fact that additional, finer or less bulky stuffer picks 21, are located in the central section or zone 20*a*. Each of the additional stuffer picks 21 extends only the width of the central section 20*a* having been sheared off where they floated over the edge sections and are in general alignment with the opposed edge stuffer picks 17 which occupy the same diamond-shaped opening 16.

FIG. 4 may be considered to be a longitudinal cross sectional view through either of the sections or zones 18*a* or 19*a* of FIG. 5. FIG. 6 is a longitudinal cross sectional view through the central zone 20*a* of FIG. 5. It will be immediately apparent that the stuffer picks 21 are so selected as to have a smaller size or less bulk than stuffer picks 17. As a result, the dryer fabric 12*a* will differ from dryer fabric 12 in that the central zone or section 20*a* will have a somewhat lesser permeability than center section 20 of FIG. 2, while still having a greater permeability than edge sections 18*a* and 19*a*. Again, the width of sections 18*a*, 19*a* and 20*a* can be varied, as described with respect to the embodiment of FIGS. 2 through 4.

The embodiment of FIGS. 5 and 6 is made much in the same manner as that previously described in connection with the aforementioned embodiment. In a manner identical to that previously described, the relatively coarse stuffer yarn 17 is interwoven only in the edge of zones 18*a* and 19*a* with surface floats therebetween. Again, the surface floats (non-interwoven segments) may be easily lifted by hand and removed by shearing. In the case of the relatively fine or less bulky stuffer yarns 21, they are interwoven only in the central zone 20*a*, with surface floats through edge zones 18*a* and 19*a*. In like manner, the surface floats for fine yarns 21 may be removed by shearing.

Figure 7:
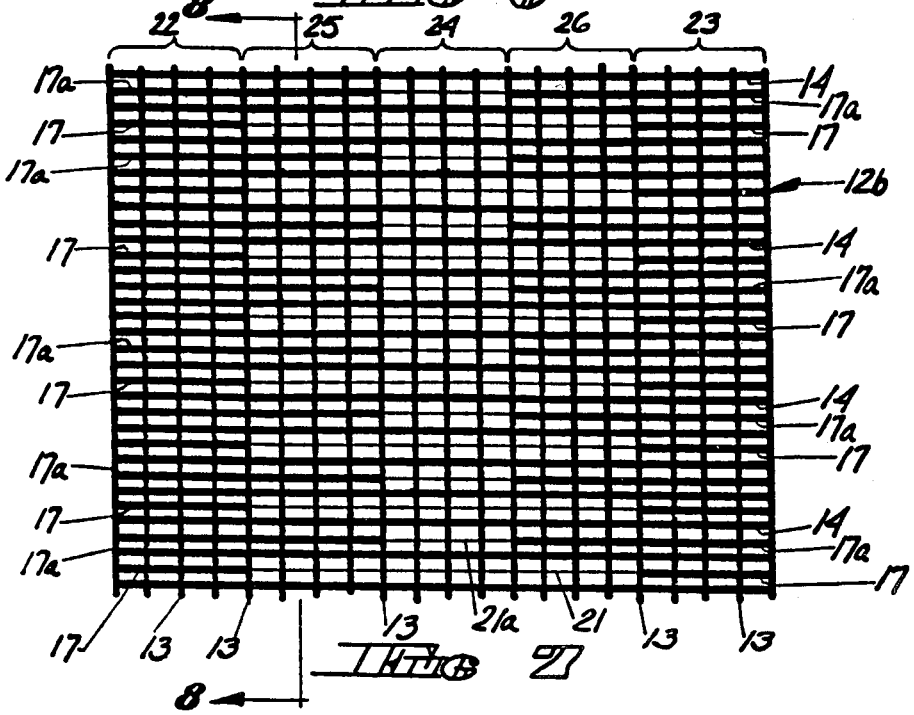
FIG. 7 is a fragmentary semi-diagrammatic plan view of a third embodiment of the dryer fabric of the present invention.
Figure 8:
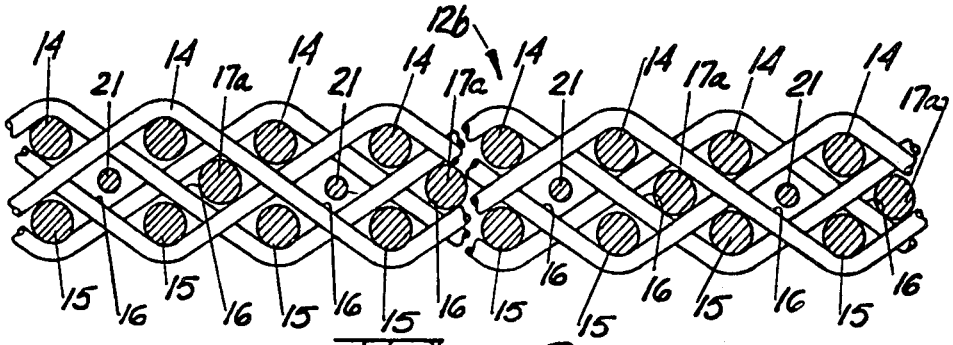
FIG. 8 is a fragmentary, semi-diagrammatic cross sectional view taken along section line 8—8 of FIG. 7.

A third embodiment of the present invention, generally indicated at 12*b*, is illustrated in FIGS. 7 and 8. For purposes of an exemplary illustration, the dryer fabric 12*b* is shown as being woven of a simple duplex weave. Warp or machine direction yarns are again shown at 13 and weft of filling yarns, extending in the cross machine direction, are again illustrated at 14.

As in the previous embodiments, stuffer picks are provided at the edge portions of the dryer fabric 12*b*. Stuffer picks similar to those of the previous embodiments are shown at 17. Fabric 12*b* differs from the previous embodiments in that alternate edge stuffer picks are interwoven over longer distances, extending inwardly from the edge of the dryer fabric toward the center a greater distance. These stuffer picks are illustrated at 17*a*.

Dryer fabric 12*a* is also provided with stuffer picks of lesser diameter or bulk extending between the edge stuffer picks. Those intermediate stuffer picks extending between edge stuffer picks 17 are identical to those illustrated in FIG. 5 and are again given index numeral 21. Those intermediate stuffer picks extending between elongated stuffer picks 17*a* are, of course, shorter and are indicated by index numeral 21*a*.

As a result of this construction, it will be evident from FIG. 7 that the dryer fabric 12*b* is divided into five zones or sections across its width (i.e. in the cross machine direction). First of all, there are the edgemost sections 22 and 23. These sections are equivalent to edge sections 18 and 19 of FIG. 2 and 18*a* and 19*a* of FIG. 5. Therefore, the cross sectional view, FIG. 4, can be considered to be illustrative of the longitudinal cross section of sections 22 and 23 of FIG. 7, differing only in that alternate ones of the stuffer picks of FIG. 4 would bear the index numeral 17*a*. These edgemost sections or zones would have the least permeability.

The centermost section 24 of dryer fabric 12*b* is substantially identical to the center section 20*a* of FIG. 5, except that it is considerably narrower. The cross sectional view, FIG. 6, can be considered to be illustrative of the cross section of center section 24 of FIG. 7, with the exception that alternate ones of the stuffer picks of FIG. 6 would be designated 21*a*. This is the section of dryer fabric 12*b* having the greatest permeability.

Finally, dryer fabric 112*b* has two intermediate zones or sections 25 and 26. In these zones, stuffer picks 17*a* and 21 alternate. The longitudinal cross section of section 25 is shown in FIG. 8. It will be understood that FIG. 8 is also illustrative of the longitudinal cross section of section 26. Thus, in these sections 25 and 26 there are alternate large diameter stuffer picks and stuffer picks of lesser diameter or less bulk, yielding a permeability between that of section 24 on the one hand and sections 22 and 23 on the other. As a result, dryer fabric 12*b* has a high permeability center section 24, medium permeability intermediate sections 25 and 26 and lesser permeability edge sections 22 and 23.

Figure 9:
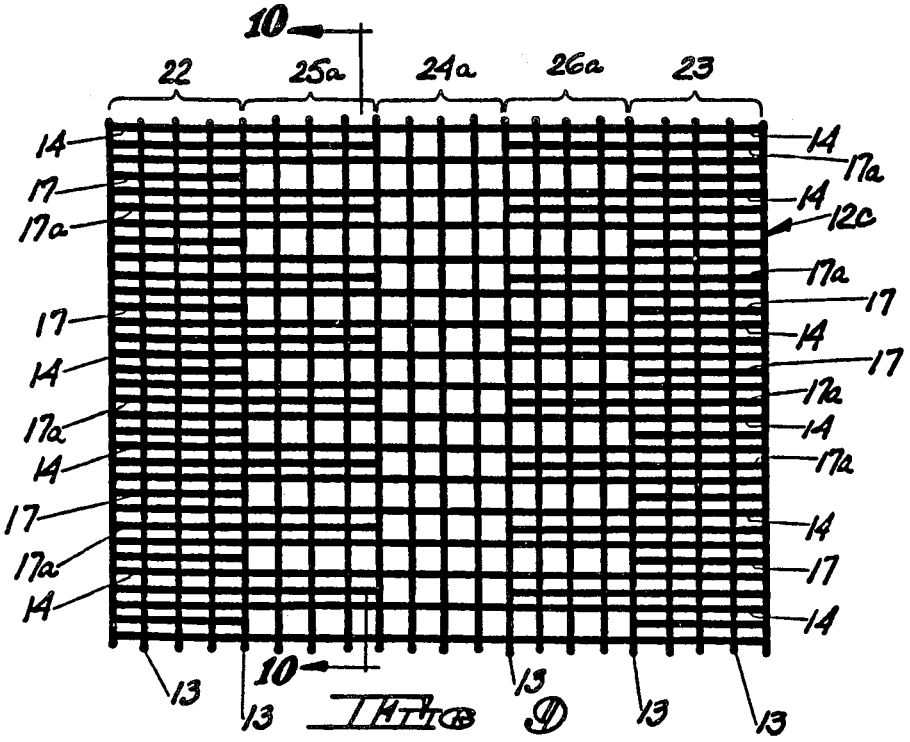
FIG. 9 is a fragmentary, semi-diagrammatic plan view of a fourth embodiment of the dryer fabric of the present invention.
Figure 10:
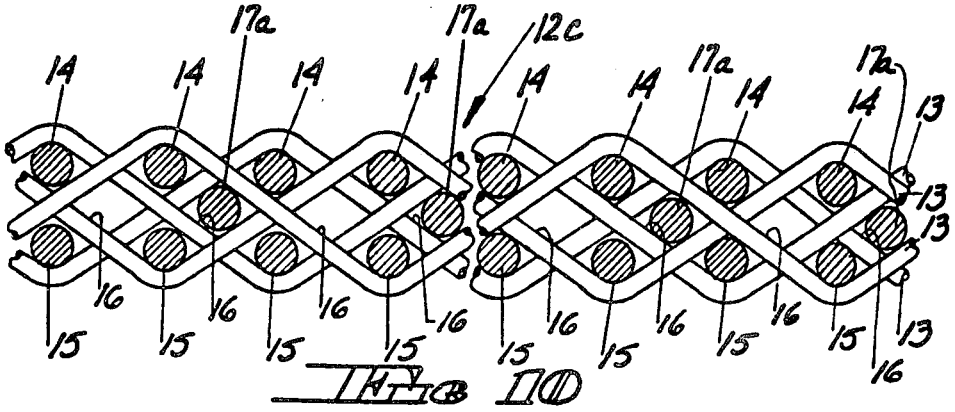
FIG. 10 is a fragmentary, semi-diagrammatic cross sectional view taken along section line 10—10 of FIG. 9.

FIGS. 9 and 10 illustrate a fourth embodiment of the present invention wherein the dryer fabric is designated generally at 12*c*. Dryer fabric 12*c* is identical to dryer fabric 12*b* of FIGS. 7 and 8, with the sole exception that the stuffer picks 21 and 21*a* of lesser diameter or less bulk have been omitted. In FIGS. 9 and 10, like parts have been given the same index numerals as in FIGS. 7 and 8.

Once again, dryer fabric 12*c* is a five zone or section fabric. Thus, fabric 12*c* has edge zones 22 and 23 identical to edge zones 22 and 23 of fabric 12*b* of FIG. 7. Fabric 12*c* has a central zone 24*a*, the same width as zone 24 of FIG. 7, but with the lesser diameter or lesser bulk stuffer picks 21 and 21*a* omitted. In a similar fashion, the intermediate zones 25*a* and 26*a* of dryer fabric 12*c* differ from the intermediate zones 25 and 26 of dryer fabric 12*b* only in that the lesser diameter or lesser bulk picks 21 have been omitted.

As a result of these differences, dryer fabric 12*c* will have the same permeability at its edges, as does dryer fabric 12*b*. The central zone 24*a* of dryer fabric 12*c* will have the maximum permeability, and therefore a permeability greater than the central zone 24 of dryer fabric 12*b*. FIG. 10 is a diagrammatic cross sectional view illustrating the longitudinal section of zone 25*a* of dryer fabric 12*c*. It will be understood that FIG. 10 can also be considered to be illustrative of the longitudinal section of intermediate zone 26*a* FIG. 9. Since the lesser diameter or lesser bulk picks 21 are omitted in sections 25*a* and 26*a*, these sections will have a lesser permeability than center section 24*a*, but a greater permeability than the intermediate sections 25 and 26 of dryer fabric 12*b*.

The four embodiments described above are exemplary only of the manner in which the teachings of the present invention can be employed to produce dryer fabrics having zones of different permeabilities across its width (i.e., in the cross machine direction). While all of the embodiments, for purposes of an exemplary showing, have been illustrated in the form of a dryer fabric made up in a simple duplex weave, it will be understood that any appropriate multi-layer weave can be used which will enable the introduction of stuffer picks. By varying the nature of the stuffer picks and their locations, a large variety of dryer fabrics of differing permeabilities across their widths can be achieved.

Since, in accordance with the teachings of the present invention, the frequency of the warp or machine direction yarns is uniform and has not been altered across the fabric width, significant differences in load bearing characteristics across the width of the dryer fabrics have not been introduced. It is recommended that the stuffer picks not be harder or stiffer and more rigid than the base picks.

In dryer fabrics of the type taught in the above mentioned U.S. Pat. No. 3,867,766, it has been found that the load bearing properties or stretch characteristics of the edge sections and the center section can differ in a proportion as high as 1:3.5. The dryer fabrics of the present invention demonstrate much more nearly uniform load bearing properties or stretch characteristics of the various zones across their widths.

EXAMPLE I

A dryer fabric of the type illustrated in FIG. 5 was made, utilizing a simple duplex weave. The warp or machine direction yarns 13 were 20 mil monofilament synthetic yarns at a frequency of 52 yarns per inch. Both polyester and nylon yarns were used, arranged in alternate groups of four across the width of the dryer fabric.

The filling or cross machine direction yarns 14 and 15 were 20 mil monofilament polyester yarns. The outer stuffer picks 17 were 0.7 cotton count yarns spun of polyester staple fibers. The center stuffer picks 21 were 4/4 cotton count yarns spun of polyester staple fibers. The overall pick frequency was 41 per inch, including the stuffer picks.

The dryer fabric had a width of approximately 275 inches, the outer zones 18*a* and 19*a* being approximately 40 inches wide and the central zone 20*a* being approximately 195 inches wide. The dryer fabric was heat set in a conventional manner to heat stabilize the fabric and to achieve the final desired dimensions.

The permeabilities of the sections 18*a*, 19*a* and 20*a* were tested utilizing a standard Frazier air permeability tester, yielding the permeability values in cubic feet per minute per square foot of fabric at a pressure drop of 0.5 inches of water. The sections or zones 18*a* and 19*a* demonstrated a permeability of approximately 90 cubic feet per minute, while the central section 20*a* demonstrated a permeability of approximately 180 cubic feet per minute.

Samples from sections 18*a*, 19*a* and 20*a* were subjected to a standard stretch test at 0.65% elongation in the machine direction. Under these circumstances, the edge sections 18*a* and 19*a* demonstrated a force of 9.7 pounds per inch of width while the center sections 20*a* demonstrated a a force of 7.3 pounds per inch of width. Thus, the difference in load bearing properties between the edge sections 18*a* and 19*a* and the center section 20*a* was in the proportion of 1:1.3. Thus, it can be seen that the various sections of the fabric demonstrated very nearly the same load bearing characteristics.

EXAMPLE II

A second dryer fabric of the type illustrated in FIG. 9 was manufactured, utilizing a simple duplex weave. The warp or machine direction yarns 13 were 3,250 denier continuous multifilament polyester yarns arranged at a frequency of 32 ends per inch. The filling or cross machine direction yarns (including the stuffer picks) were 100% fiberglass continuous multifilament yarns arranged at a frequency of 36 picks per inch in the edge sections 22 and 23, 30 picks per inch in the intermediate sections 25*a* and 26*a* and 24 picks per inch in the central section 24*a*. When subjected to the permeability tests described with respect to Example I, the edge regions 22 and 23 demonstrated a permeability of 100 cubic feet per minute, the intermediate sections 25*a* and 26*a* demonstrated a permeability of 275 cubic feet per minute, while the central section 24*a* demonstrated a permeability of 400 cubic feet per minute.

The dryer fabric of this example had an approximate of width of 280 inches, the edge sections 22 and 23 being approximately 44 inches, the intermediate sections 25*a* and 26*a* being approximately 38 inches and the center section 24*a* being approximately 116 inches. The dryer fabric was resin treated to enhance the stability of the fabric and was heat set in a conventional manner to heat stabilize the fabric and to bring it to the final required dimensions.

Samples of the five sections 22, 23, 25*a*, 26*a* and 24*a* were subjected to a standard stretch test, as explained in Example I above. At 1.3% elongation in the machine direction, the edge sections 22 and 23 demonstrated a force of 8.75 pounds per inch of width. The intermediate sections 25*a* and 26*a* demonstrated a force of 7.6 pounds inch of width and the center section 24*a* demonstrated a force of 8 pounds per inch of width. Again, it will be noted that the machine direction load bearing characteristics were very much more uniform than those of the prior art, being in a ratio of 1:1.5 between the highest and the lowest.

The dryer section of a conventional paper machine employs four or more dryer fabrics in the form of endless belts. Accordingly, those skilled in the art will recognize that the benefits affected of the present invention, is enhanced as the number of fabrics of the present invention, replacing conventional dryer fabrics, is increased in the dryer section.

The present invention is also considered to include embodiments wherein, for example, the permeability of the center longitudinal zone is less than that of the edge's zones due to the presence of additional, thicker or more bulky stuffer yarns in the central zone.

Modifications may be made in the invention without departing from the spirit of it.

What is claimed is:

1. A method for making an endless a dryer fabric belt having zones of different permeability for use in a papermaking machine:

weaving machine direction and cross machine yarns into a multi-layer weave while interweaving additional cross machine direction stuffer yarns into only a selected zone or zones across the width of the fabric; and removing from the fabric, by shearing, those segments of said additional cross machine direction yarns which are not interwoven, to produce longitudinally extending zones in said dryer fabric across the width thereof of different fluid permeabilities.

2. The method of claim 1 wherein said additional cross machine direction yarns are interwoven in a first zone extending from one longitudinal edge of said fabric toward the center thereof a predetermined distance and interwoven in a second zone extending from the other longitudinal edge of said fabric toward the center thereof a predetermined distance, with surface floats extending between said first and second zones, said surface floats being removed by said shearing.

3. The method of claim 1 wherein said additional cross machine direction yarns are of two different types, a first type of said additional cross machine direction yarn being interwoven only into a selected zone or zones across the width of the fabric and the second type of additional cross machine direction yarn being woven only into a different zone or zones, and wherein all of the non-interwoven yarn segments of said additional cross machine direction yarns constitute surface floats which are removed from the fabric by shearing.

4. The method of claim 3 wherein said additional cross machine direction yarns of said first type are interwoven only in zones at the longitudinal edges of the fabric and said yarns of said second type are interwoven only in the central zone spanning said edge zones.

5. The method of claim 4 wherein said yarns of said first type are, alternately, interwoven over at least two different distances, said yarns of said second type being interwoven through the center of fabric over distances spanning the points where the interweaving of said yarns of said first type is terminated, thereby providing two edge zones of lesser fluid permeability, a central zone of higher fluid permeability and at least two intermediate zones of intermediate fluid permeability.

6. The method of claim 5 wherein said yarns of said first type consist of only two different lengths.

7. The method of claim 2 wherein said additional cross machine direction yarns are, alternately, interwoven over at least two different distances extending from said longitudinal edges, thereby, upon said shearing, providing a fabric having two edge zones of lesser fluid permeability, a central zone of higher fluid permeability and at least two intermediate zones of intermediate fluid permeability.

8. The method of claim 7 wherein only two different lengths of said additional cross machine direction yarns are interwoven.

9. The method of claim 3, 4, 5 or 6 wherein said yarns of said first type have a larger diameter than said yarns of said second type.

10. The method of claim 3, 4, 5 or 6 wherein said yarns of said first type are bulkier than said yarns of said second type.

11. The method of claim 1 wherein said fabric is woven endless.

12. The method of claim 2 wherein said fabric is woven endless.

13. The method of claim 1 wherein said fabric is woven flat and opposite ends are joined together to form the endless belt.

14. The method of claim 2 wherein said fabric is woven flat and opposite ends are joined together to form the endless belt.

* * * * *